United States Patent [19]

Oka et al.

[11] Patent Number: 5,063,127

[45] Date of Patent: Nov. 5, 1991

[54] METHOD FOR FORMING MULTI-COLOR IMAGES

[75] Inventors: Tateki Oka; Tomoaki Yokoyama, both of Osaka, Japan

[73] Assignee: Minolta Camera Kabushiki Kaisha, Osaka, Japan

[21] Appl. No.: 439,581

[22] Filed: Nov. 21, 1989

[30] Foreign Application Priority Data

Nov. 22, 1988 [JP] Japan ..... 63-295379
Nov. 22, 1988 [JP] Japan ..... 63-295380

[51] Int. Cl.[5] ..... G03G 15/01

[52] U.S. Cl. ..... 430/45; 430/126; 355/326

[58] Field of Search ..... 430/45, 42, 126; 355/326

[56] References Cited

U.S. PATENT DOCUMENTS 4,264,185 4/1981 Ohta ..... 430/45
4,416,533 11/1983 Tokunaga et al. ..... 355/4
4,822,702 4/1989 Hoshi et al. ..... 430/42
4,937,630 6/1990 Yoshikawa et al. ..... 430/45

FOREIGN PATENT DOCUMENTS 58-102251 6/1983 Japan .
58-137846 8/1983 Japan .

*Primary Examiner*—John Goodrow
*Attorney, Agent, or Firm*—Burns, Doane, Swecker & Mathis

[57] ABSTRACT

A first electrostatic latent image on an image bearer is developed with a first toner in a first developing unit, and a second electrostatic latent image thereon is developed with a second toner in a second developing unit, wherein the first toner is transmittable to the image bearer at a lower bias voltage than the second toner, and wherein the second toner and a foreign first toner mixed in the second developing unit are chargeable to the same polarity by friction with a carrier contained in the second developing unit; the second developing unit is put into operation for a non-image forming portion of the image bearer by applying a voltage thereto wherein the voltage is maintained higher than the surface potential of the non-image forming portion so as to enable the foreign first toner to adhere thereto.

17 Claims, 12 Drawing Sheets

SURFACE POTENTIAL
-600(V)=Vo1
Vo1'=-480(V)
W1
W2
IMAGE WIDTH
0

-450(V)=VB1
Tc
-50(V)
0
1ST DEVELOPING RANGE

-700(V)=Vo2
Vo1'=-480(V)
2ND CHARGING RANGE
0

Vo2
-60(V)
0

Tc'
-550(V)=VB2
Tb
REMOVAL OF FOREIGN TONER
2ND DEVELOPING RANGE

1ST CHARGE

1ST EXPOSURE

1ST DEVELOPMENT

2ND CHARGE

2ND EXPOSURE

2ND DEVELOPMENT

METHOD FOR FORMING MULTI-COLOR IMAGES

BACKGROUND OF THE INVENTION

The present invention relates to a method for forming multi-color images by use of an electrophotographic copying apparatus, printers, etc. and more particularly to a method for forming multi-color images with the use of a two-component dry developer.

To form a multi-color image by use of an electrophotographic copying apparatus, printers, etc. there is known a method which develops a first latent image by use of a first toner and a second latent image with a second toner charged to the same polarity as the first toner.

Referring to FIG. 12, an example of the prior art methods will be described:

There is provided a photosensitive image-bearing drum 10*a* rotatable in the direction of arrow during which charging, a first exposure, a first development, a second exposure, a second development and a toner image transfer are consecutively carried out.

More specifically, around the photosensitive drum 10*a* (hereinafter called the drum) are disposed a main charger 11*a*, a first optical system 20*a*, a first developing unit 13*a*, a second charger 14*a*, a second optical system 30*a*, a second developing unit 16*a*, a transferring charger 17*a*, a cleaning device 18*a*, and an eraser 19*a*. The development is conducted by steps 1 to 6 shown in FIG. 13 so as to form a two-color image.

Step (1): The surface of the drum 10*a* is charged at a potential $V_{O1}$ by the main charger 11*a*, wherein the potential $V_{O1}$ is normally −500 to −1000 V.

Step (2): The drum 10*a* is exposed to a laser beam 12*a* from the first optical system 20*a*, etc. to form a first latent image.

Step (3): The first latent image is subjected to reversal development by the first developing unit 13*a* at a bias voltage $V_{B1}$ with the use of a two-component developer containing a color toner $T_c$ and a carrier.

Step (4): Where required, the second charger 14*a* is used to charge the surface of the drum 10*a* at a potential $V_{O2}$.

Step (5): The charged drum 10*a* is exposed to a laser beam 15*a* etc. from the second optical system 30*a* to form a second latent image.

Step (6): The drum surface having the second latent image is subjected to reversal development by the second developing unit 16*a* at a bias voltage $V_{B2}$ with the use of a two-component developer containing a black toner $T_b$ and a carrier.

Step 7: The two-color toner image is transferred onto a recording material such as paper by the transferring charger 17*a*, and fixed thereon by a fixing device (not shown).

This prior art method has disadvantages; one is that some toner $T_c$ used for the first development intrudes into the developer used for the second development. Hereinafter a portion of one toner which mixes with another is called "foreign toner". The more sheets are copied, the more turbid the second developer becomes with a foreign first toner. This problem is particularly remarkable when the developing unit is a magnetic brush type, because the first toner image formed on the drum surface is scraped off by the magnetic brush thereby to cause some of the first toner to mix with the second developer.

In order to avoid the problem of mixed colors, it is important to remove the foreign first toner out of the second developer for which the following methods have been proposed:

1. The polarity of the foreign toner is reversed to effect electrostatic separation. One example is disclosed in U.S. Pat. No. 4,822,702, and the corresponding Japanese Patent Application "Kokai" No. 58-137846. The disclosed method has an arrangement in which the first toner, the second toner and the carrier are arranged in a frictional electricity series so as to effect the reversal of polarity of the foreign first toner. Thus the foreign first toner is removed out of the second developing unit, or adheres to a non-image forming portion of the drum, or else picked up by a roller-type collector.

2. The development thresholds of the first and the second toner are differentiated, which means that the first toner and the second toner require different initiating potentials, and the foreign toner is removed by adhering to the surface of a bias-applied roller. This method is disclosed in Japanese Patent Application "Kokai" No. 58-102251. This is practised by using a first non-magnetic color toner and a second magnetic black toner, and disposing the bias-applied roller in the second developing unit. No magnetic black toner adheres to the roller because of being its magnetic threshold whereas the non-magnetic color toner adheres thereto when the roller is electrically biased. In this way the foreign toner is removed out of the second toner.

The methods described above have the following disadvantages:

In the method (1) the frictional series must be properly regulated, which may limit a range for selecting the kinds of toner components. Another disadvantage is that the performance is susceptible to external conditions such as atmospheric temperature and humidity. A further disadvantage is that the toner scatters and stains the inside of the apparatus, which requires a suction duct or the like for removing it. As a result the apparatus becomes large.

One disadvantage of the method (2) is that a relatively large developing unit is required for accommodating the bias-applied roller, and another disadvantage is that an extra means is required for collecting the foreign toner separated by the bias-applied roller.

SUMMARY OF THE INVENTION

Accordingly, an object of the present invention is to provide a method for forming a multi-color image, wherein a first electrostatic latent image formed on an image bear is developed with a first toner by a first developing unit, and a second electrostatic latent image formed thereon is developed with a second toner by a second developing unit, the method ensuring that:

1. No detrimental mixed colors result even if the first toner upstream intrudes into the second toner downstream;

2. The toners can be selected in a wide range;

3. The scattering of toner is minimized when a foreign toner is removed.

4. No bias-applied roller is required, thereby allowing a small-size developing unit.

5. No extra means is required for collecting a foreign toner separated from the developer in the second developing unit.

According to one aspect of the present invention, there is provided a method for forming a multi-color image, which develops a first electrostatic latent image formed on an image bearing member, hereinafter called "image bearer" with a first toner stored in a first developing unit, and develops a second electrostatic latent image formed on the image bearer with a second toner stored in a second developing unit, wherein:

1. The first toner is transmittable to the image bearer at a lower bias voltage than the second toner.

2. The second toner and a foreign first toner mixed in the second developing unit are chargeable to the same polarity by friction with a carrier in the second developing unit.

3. The foreign first toner is adhered to a portion of the image bear where neither of the electrostatic latent image or a toner image is formed; hereinafter this portion is called "non-image forming portion".

There can be several methods for enabling a foreign first toner to adhere to the non-image forming portion of the image bearer:

According to one aspect of the present invention, the second developing unit is put into operation for a non-image forming portion, and a bias voltage is applied to the second developing unit wherein the voltage is maintained to be higher than the surface potential of the non-image portion so that the foreign first toner can adhere thereto. Preferably, a non-magnetic toner is used for the first toner, and a magnetic toner is used for the second toner, and both toners contains the same charge control agent.

It is also preferred that the image bearer surface is charged by a first charger prior to forming the first electrostatic latent image thereon, and is charged by a second charger prior to forming the second electrostatic latent image thereon.

In enabling the foreign first toner to adhere to the non-image forming portion of the image bearer, it is alternatively practicable to put the first charger or the second charger into operation for the non-image forming portion or else keeping either of them out of operation for the non-image portion.

It is also possible to enable the foreign toner to adhere to the non-image forming portion by employing a rotary image bearer. The rotary image bearer is provided with an image-forming portion for forming the first and the second electrostatic latent image thereon, and a non-image forming portion adjacent to the image-forming portion. While the second electrostatic latent image is developed by the second developing unit, a higher bias voltage is applied thereto than the surface potential of the non-image forming portion so that the foreign first toner in the second developing unit can adhere to the non-image forming portion.

It is preferable that a non-magnetic toner is used for the first toner, and a magnetic toner is used for the second toner, and both toners contain the same charge control agent.

It is possible that before the first electrostatic latent image is formed the image bearer is charged by the first charger having a length corresponding to the length of the image-forming portion of the image bearer; before the second electrostatic latent image is formed on the image bearer, its surface is charged by the second charger having a length corresponding to the image-forming portion, and the non-image forming portion is charged by a third charger having a length corresponding to the length of the non-image forming portion.

It is possible that the image-forming portion and the non-image forming portion are photosensitive.

Preferably the non-image forming portion is electrically conducive but insulated from the image forming portion. In this case, while the second electrostatic latent image is developed by the second developing unit, a voltage is applied to the non-image forming portion of the image bearer instead of employing the third charger so that the foreign first toner in the second developing unit sticks to the non-image forming portion. The image-forming portion can be photosensitive.

According to a further aspect of the present invention, there is provided a method for forming multi-color images, which comprises the steps of forming a first electrostatic latent image on an image bearer through a first exposure; developing the first electrostatic latent image into a first toner image by using a first non-magnetic color toner under a first voltage; forming a second electrostatic latent image on the image bearer through a second exposure; developing the second electrostatic latent image into a second toner image by applying a second voltage and using a second magnetic color toner charged to the same polarity as that of the non-magnetic toner; transferring electrostatically the first toner image and the second toner image onto a recording material; and conducting the same process for the non-image forming portion of the image bearer at a third voltage as the process of applying the second voltage to the magnetic toner to form the second toner image, wherein the third voltage unlike the second voltage is maintained to be higher than the surface potential of the non-image forming portion.

The method further comprises the steps of charging the image bearer uniformly before the first electrostatic latent image is formed thereon, and charging the image bearer uniformly before the second electrostatic latent image is formed thereon.

According to a further aspect of the present invention, there is provided a method for forming a multi-color image, which comprises the steps of preparing an image bearer including an image-forming portion and a non-image forming portion carried on the same axis; forming a first electrostatic latent image on the image-forming portion of the image bearer through a first exposure; developing the first electrostatic latent image into a first toner image by using a first non-magnetic color toner applying a voltage to the developing unit; forming a second electrostatic latent image on the image-forming portion of the image bearer through a second exposure; developing the second electrostatic latent image into a second toner image by applying a voltage and using a second magnetic color toner charged to the same polarity as that of the first non-magnetic color toner, wherein the voltage is maintained to be higher than the surface potential of the non-image forming portion; and transferring electrostatically the first toner image and the second toner image onto a recording material.

The method may additionally comprise the steps of charging the image-forming portion prior to forming the first electrostatic latent image thereon, charging the non-image forming portion subsequently to the first charging of the image forming portion, and charging the image forming portion prior to forming the second electrostatic latent image.

Other objects and advantages of the present invention will become more apparent from the following detailed description, when taken in conjunction with the accompanying drawings which show, for the purpose of illustration only, embodiments in accordance with the present invention.

BRIEF DESCRIPTION OF THE DRAWINGS

FIG. 4(3) is a diagrammatic view showing the process of development in an inter-image forming period;

DETAILED DESCRIPTION OF THE PREFERRED EMBODIMENTS

Figure 1:
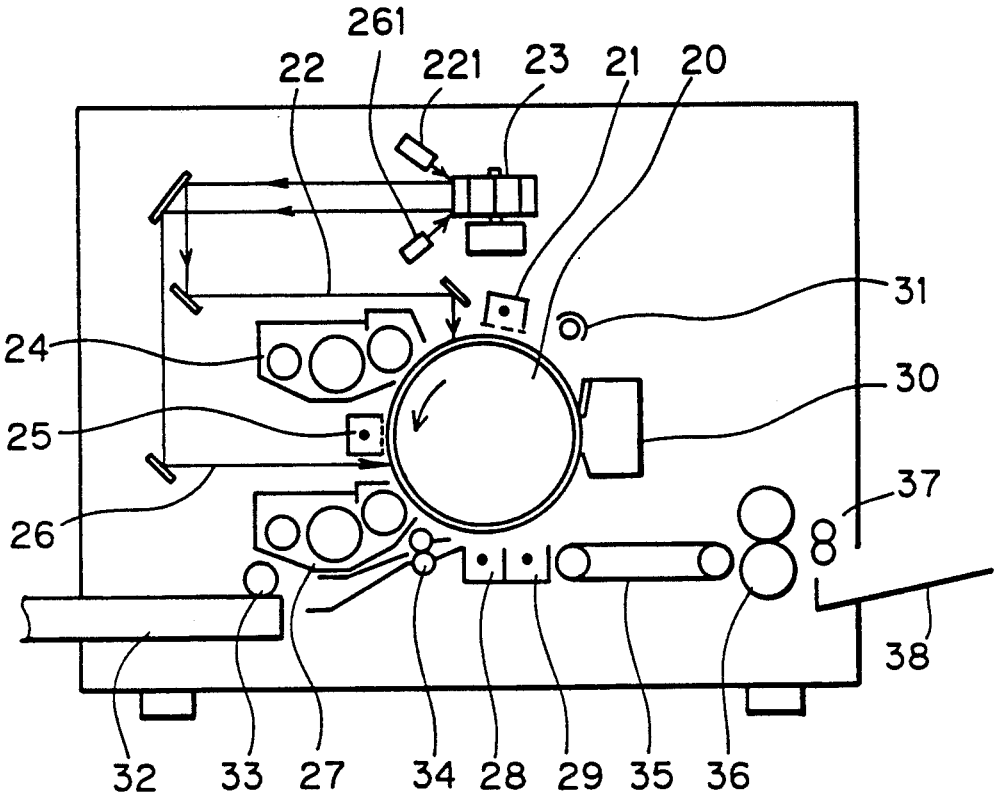
FIG. 1 is a schematic view showing the structure of a printer for carrying out a method according to the present invention.

FIG. 1 shows an example of an electrophotographic two-color printer for carrying out the method of the present invention.

The printer includes an organic photosensitive drum 20, hereinafter called the drum, in the center, the drum 20 functioning as an image bearer. Disposed around the drum 20 are a first charger (scorotron) 21, a first developing unit 24, a second charger (scorotron) 25, a second developing unit 27, a transfer charger 28, a sheet separating charger 29, a cleaning device 30 and an eraser lamp 31.

Disposed above the drum 20 are a polygon scanner 23, and an optical system including a first and a second laser head 221, 261 for casting a light corresponding to the image onto the scanner.

Upstream of the transfer charger 28 are disposed a cassette 32 storing a stack of paper or any other recording material, a feed roller 33 for feeding the recording material in the cassette 32 and timing rollers 34 which feed the recording material synchronously with the image formed on the drum 20.

Downstream of the sheet separating charger 29 are disposed a conveyor belt 35 for feeding the recording material bearing a transferred image, fixing rollers 36, discharging rollers 37 and a tray 38.

Figure 2:
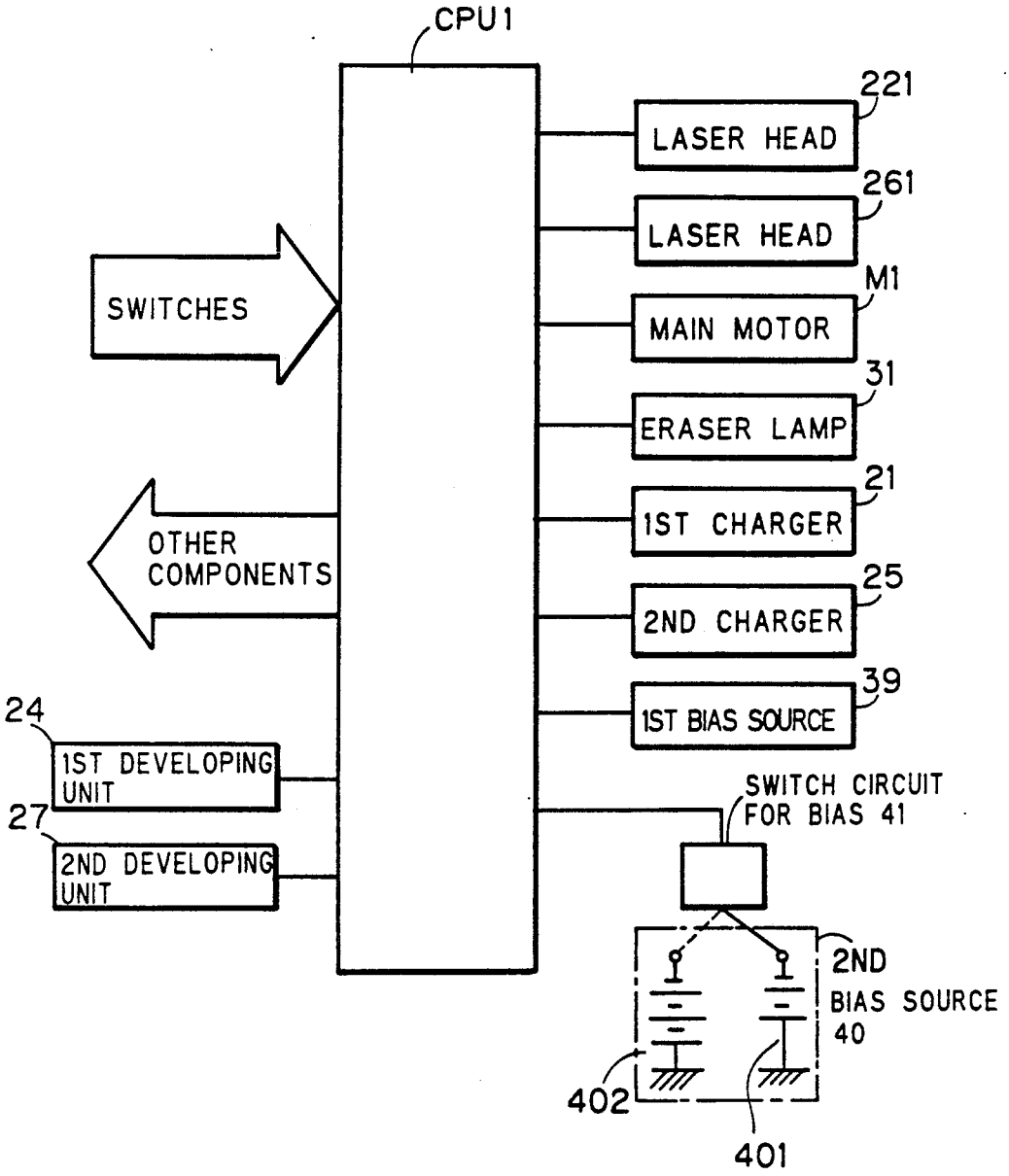
FIG. 2 is a diagram showing a control system of the printer of FIG. 1.

FIG. 2 shows a control system incorporated in the printer, the control system including a micro-computer CPU1. The CPU1 is connected to the laser heads 221, 261, the eraser lamp 31, the first charger 21, the second charger 25, the first developing unit 24, the second developing unit 27, and though not shown in FIG. 1, a main motor M1, a first bias voltage source or a first bias source 39 for the first developing unit 24, a second bias voltage source 40 for the second developing unit 27, and other components so that they are operated under control of the CPU1. The bias voltage source 40 includes a first electric source 401 for developing an electrostatic latent image and a second electric source 402 for removing a foreign toner. The electric sources 401 and 402 are selectively switched on or off by a circuit 41. The CPU1 receives inputs from a printer starting switch etc. on a control panel (not shown). The drum 20, the feed rollers 33, the timing rollers 34, the conveyor belt 35, the fixing rollers 36 and discharging rollers 37 are driven by the main motor M1.

The drum 20 is an organic photosensitive drum, having a diameter of 100 mm and rotating at a surface linear speed of 110 mm/sec (system speed).

The first developing unit 24 is a magnetic brush type, which includes a fixed magnetic roller and a developing sleeve rotating around the magnetic roller. The first developing unit 24 stores a two-component developer containing a carrier and a toner. The carrier is made of virtually spherical ferrite having an average diameter of 60 μm. The toner is a non-magnetic red toner and is charged to the negative polarity by friction with the carrier. More specifically, 100 parts by weight of styrene-acrylic copolymer, 4 parts by weight of a negative charge control agent and 5 parts of red pigment are mixed in their molten states, and after cooling, the resulting solid mass is crushed to granules and filtered to obtain particles having an average diamter of 11 μm. For the negative charge control agnets a dye obtained by chelating Cr, Co, Fe, Al or any other metal can be used; in the illustrated embodiment "Bontron S-34" (produced by Oriental Chemical Co., Ltd.) made of chelated chromium is used. There are many red pigments which can be used; in the illustrated embodiment Watchung Red is used. The density of the toner in the developer is 5% by weight.

The second developing unit 27 is also a magnetic-brush type, which includes a stationary magnetic roller and a developing sleeve rotating around the magnetic roller. The developing unit 27 stores a two-component developer containing a toner and a bindertype carrier having an average diameter of 58 μm. The toner consists of magnetic black particles having an average diameter of 12 μm, and is chargeable to the negative polarity for the carrier by friction therewith. Hundred parts by weight of styrene-acrylic copolymer, 5 parts by weight of a negative charge control agent (e.g. "Bontron S-34"), 4 parts of carbon black, and 40 parts by weight of a magnetic powder are mixed in their molten states, and after cooling the resulting solid mass is rushed to granules and filtered to obtain particles having an average diameter of 12 μm. The density of the toner in the second developer is 15% by weight.

Figure 3:
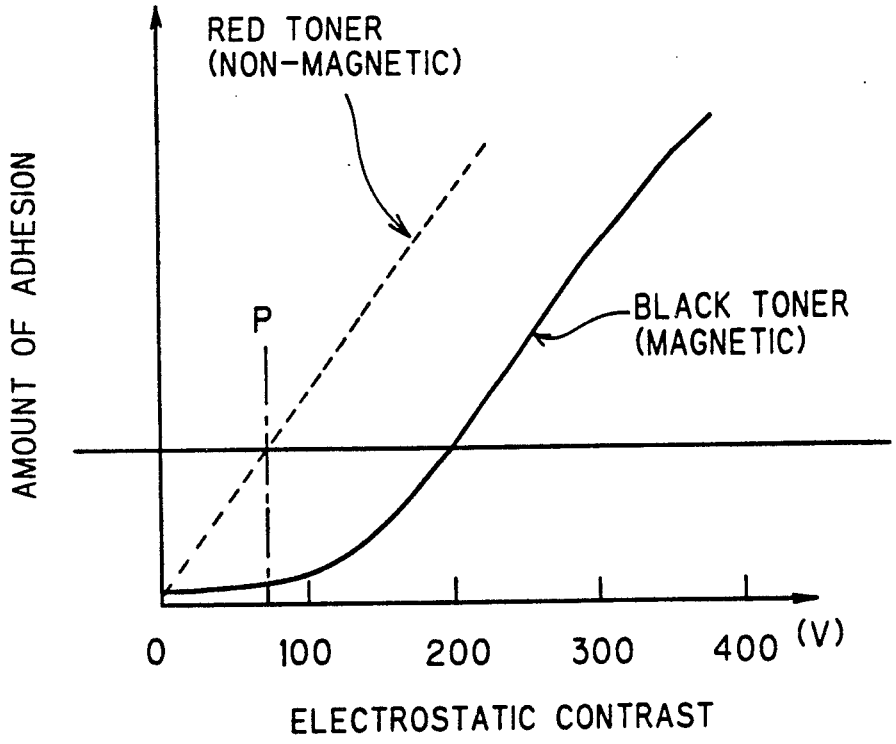
FIG. 3 is graphs showing the relationship between an adherence of each of a non-magnetic red toner and a magnetic black toner to a photosensitive image bearer and an electrostatic contrast.

FIG. 3 is a graph comparatively showing the relationships in the red (non-magnetic) toner and black (magnetic) toner between the amount of toner attachment to the drum 20 and electrostatic contrast (V), wherein the electrostatic contrast means a voltage at which each toner is adhered to the drum 20.

It will be understood from FIG. 3 that the non-magnetic red toner attaches to the drum 20 increasingly from the contrast V=0 whereas very little magnetic black toner attaches to the drum at a point (P) for the contrast V=70. The adhesion of black toner increases with an increase in the contrast V. In the black toner the development is not effected unless the voltage exceeds 100 V, and in the red toner the development can occur below 100 V.

In the printer of FIG. 1 the drum 20 is rotated in a counter-clockwise direction (in the drawing) by the main motor M1 (FIG. 2) under control provided by the control section shown in FIG. 2. Initially the surface of the drum 20 is uniformly charged by the first charger 21, and exposed to a light 22 generated by the first laser head 221 to form a first latent image. This latent image is developed with the red toner by the first developing unit 24.

The drum surface is again charged by the second charger 25, and exposed to a light 26 generated by the laser head 261 to form a second latent image which is developed with the black toner by the second developing unit 27.

The paper is supplied by the feed rollers 33 from the cassette 32 to the timing rollers 34 and led into a gap between the drum 20 and the transfer charger 28, synchronously with the toner image on the drum 20 by the timing rollers 34. The toner image is transferred onto the paper by the transfer charger 28. The paper is separated from the drum 20 by the paper separating charger 29, and conveyed to the fixing rollers 36 where the toner image on the paper is fixed. Then the paper is discharged to the tray 38 by the discharge rollers 37.

The drum surface is cleaned by the cleaning device 30 so as to remove any remainder of toner, and a remaining charge is erased by the eraser lamp 31 to get ready for the charge subsequently provided by the first charger 21.

The potentials for forming the image are in the following relationship (refer to FIGS. 4(1) and 4(2)):

The potential $V_{O1}$ on the drum by the first charger 21: −600 (V)

The potential on the exposing section after the first exposing: −50 (V)

The bias voltage $V_{B1}$ at the first developing unit 24: −450 (V)

The potential $V_{O2}$ on the drum by the second charger 25: −700 (V)

The potential on the exposing section after the second exposing: −60 (V)

The bias voltage $V_{B2}$ at the second developing unit 27: −550 (V)

This bias voltage $V_{B2}$ is applied by a source 401 in the second bais voltage source 40 (FIG. 2).

It is arranged that the bias voltage at the second developing unit 27 is higher than that at the first developing unit 24. This is because since a magnetic restraint acts on the magnetic toner used in the second developing unit 27, the potential at the second exposing section is set to −60 (V) to increase electrostatic contrast, thereby securing a proper image density.

As the image forming process advances, some portion of the first toner (red toner) adhered to the drum surface is unavoidably scraped by the magnetic brush and gradually intrudes into the second developing unit 27.

In the illustrated embodiment the red toner and the black toner contain the same negative charge control agent, thereby minimizing the mutual charging of two toners. Each toner is negatively charged for the carrier, and sticks thereto. If the red toner enters the second developing unit 27, the toner is prevented from reversing to the opposite polarity and dispersing.

The red toner mixed with the toner in the second developing unit 27 is removed during an "inter-image period" in the following manner, wherein the "inter-image period" means a period of time for which non-image forming portion of the drum passes. Three cases are included; one is between one sheet and the next, other is a period of time before the printer automatically stops when the sheet is discharged onto the tray 38 from the discharge rollers 37, and the other is a period of time before the first sheet reaches the image transfer section.

In the inter-image period the first charger 21 and the second developing unit 27 are put into operation, wherein the bias voltage applied to the second developing unit 27 is differentiated from that applied to form an image.

The potentials in the inter-image period are as follows (FIG. 4(3)):

The potential $V_{O1}$ on the drum surface by the first charger 21: −600 (V)

The first exposure: off

The first developing unit 24: off

The second developing unit 25: off

The second exposure: off

The bias voltage $V_B$ applied to the second developing unit 27: −670 (V)

This bias voltage $V_B$ is applied by a source 402 in the second bias voltage source 40 (FIG. 2).

While the drum 20 passes by the first charger 21 in the inter-image period, its surface is uniformly charged to −600 (V) potential, and reaches the second developing unit 27 where the voltage is −670 (V). As the balance therebetween electrostatic contrast of 70 (V) occurs. It will be understood from FIG. 3 that the electrostatic contrast 70 (V) (Point (P)) is insufficient to initiate the development by use of a magnetic black toner. As a result, little black toner to adhere to the drum surface whereas the non-magnetic red toner sufficiently adheres thereto.

In this way the red toner mixed in the toner of the second developing unit 27 is selected and adhered to the drum 20. This red toner on the drum 20 is cleaned off by the cleaning device 30 without the use of a special collector.

Figure 4A:
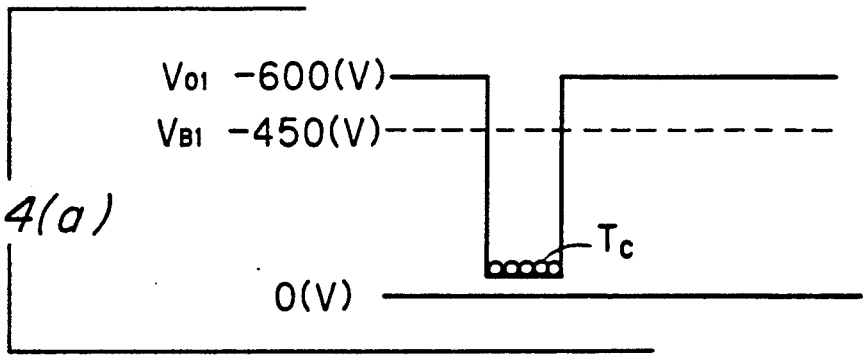
FIGS. 4(1) and 4(2) are diagrammatic views showing the process of development in an image-forming period.
Figure 4B:
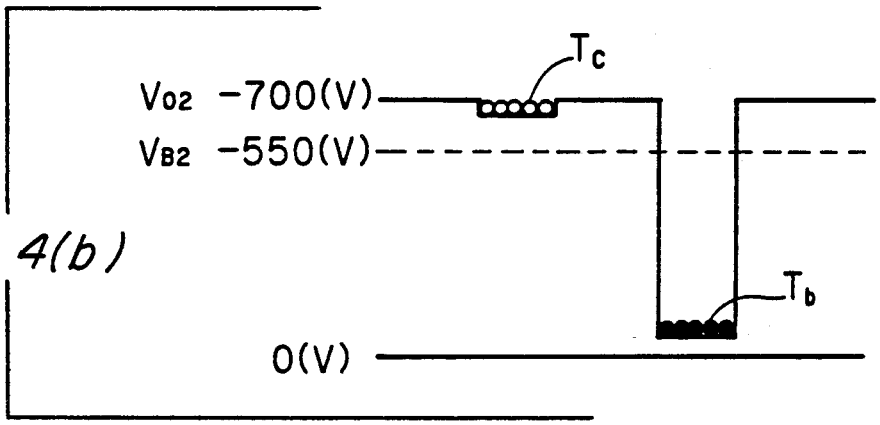
Figure 4C:
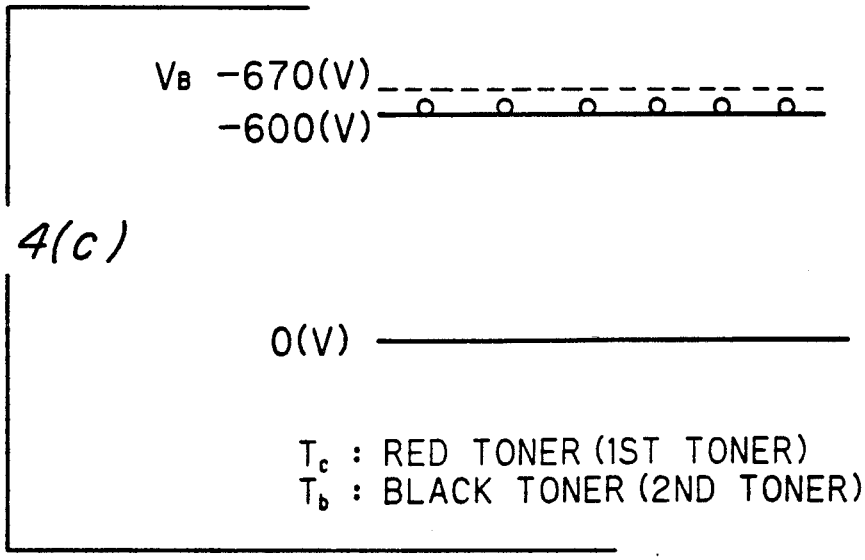

While the image is being formed, the potential $V_{O2}$ on the drum surface is at −700 (V) by the second charger 25 as shown in FIG. 4(2), and the bias voltage $V_{B2}$ is at −550 (V) for the second developing unit 27, thereby ensuring that no toner adheres to a non-image forming portion. However, as shown in FIG. 4(3) in the inter-image period the potential on the drum 20 is kept at −600 (V), and the bias voltage $V_B$ in the second developing unit is kept at −670 (V), thereby enabling the non-magnetic red toner to adhere to the drum surface 20.

Figure 5:
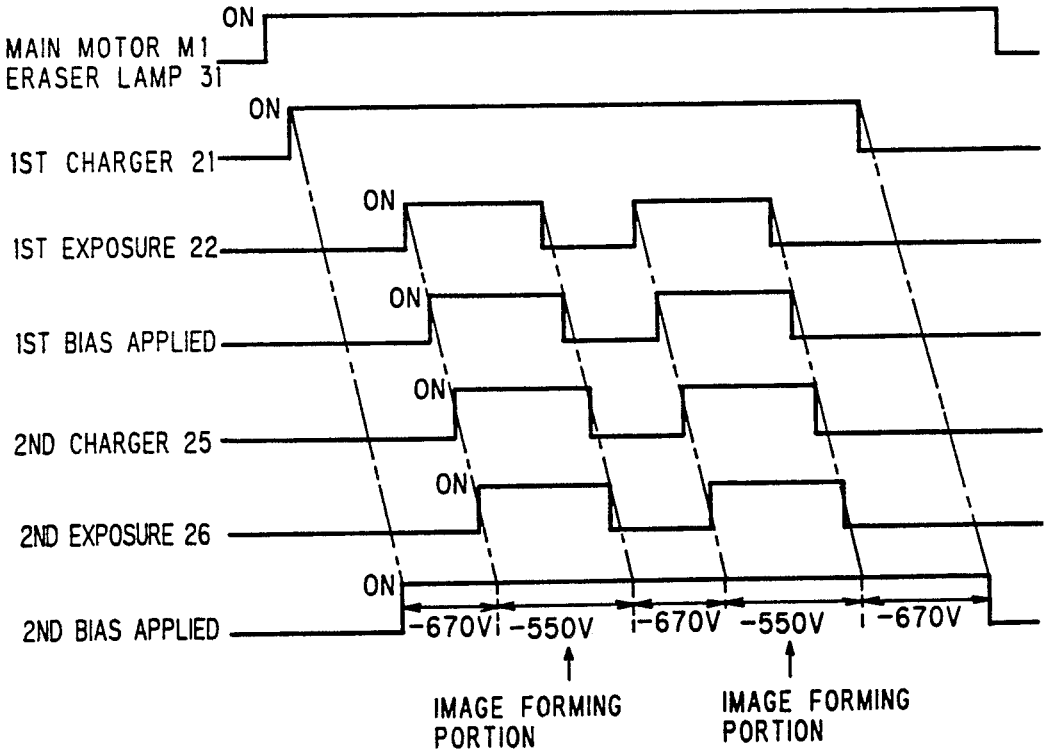
FIG. 5 is a timing chart showing the operations of each components of the printer of FIG. 1.

The timing chart of FIG. 5 shows the operations of main components of the printer in the image-forming period and the inter-image period. This timing chart shows a case where two images are formed. It will be understood from FIG. 5 that the main motor M1 and the eraser lamp 31 both continue to be in operation throughout the image-forming period and the inter-image period, and the first charger 21 is started little later than the main motor M1. Then the second developing unit 27 starts. The first charger 21 and the second developing unit 27 continue to be on throughout the image-forming period and the inter-image period. A foreign red toner mixed with the second developing unit 27 is removed at each time before the second exposing section on the drum reaches the second developing unit 27, before the second exposing section on the drum reaches the second developing unit 27 to form a subsequent image after the previous image is formed, and after the subsequent image is formed.

In the illustrated example the red toner and the black toner contain the same negative charge control agent. However it is not always essential to use the same negative charge control agent but the important thing is to ensure that no polar reversal occurs in the first toner mixed in the second developing unit 27. If this condition is satisfied, it is not necessary to use the same negative charge control agent for the two toners.

In the example a magnetic toner is used for the black toner but if sufficient electrostatic contrast is achieved to selectively separate the first toner mixed in the second developing unit, it is not necessary to use a magnetic toner.

To separate and remove the red toner, the first charger 21 is operated but it is possible to operate the second charger 24 so as to change the potential on the drum surface. For example, the potential on the drum 20 is at −470 (V) by the second charger 25 (which is effected by changing the grid voltage), and the bias voltage in the developing unit 27 is kept at −550 (V). In this case the charge by the first charger 21, the first exposure, the development by the first developing unit 24, and the second exposure do not take place.

It is also possible to remove the red toner by operating the second developing unit 27 alone without the charge by the first charger 21, the first exposure, the development by the first developing unit 24, the charge by the second charger 25, the second exposure, provided that the bias voltage is, for example, kept at −100 (V) in the second developing unit 27.

The potential on the drum surface and the bias voltage in the developing unit are not limited to the embodiment described above but it can be variously changed within the spirit of the present invention.

Figure 6:
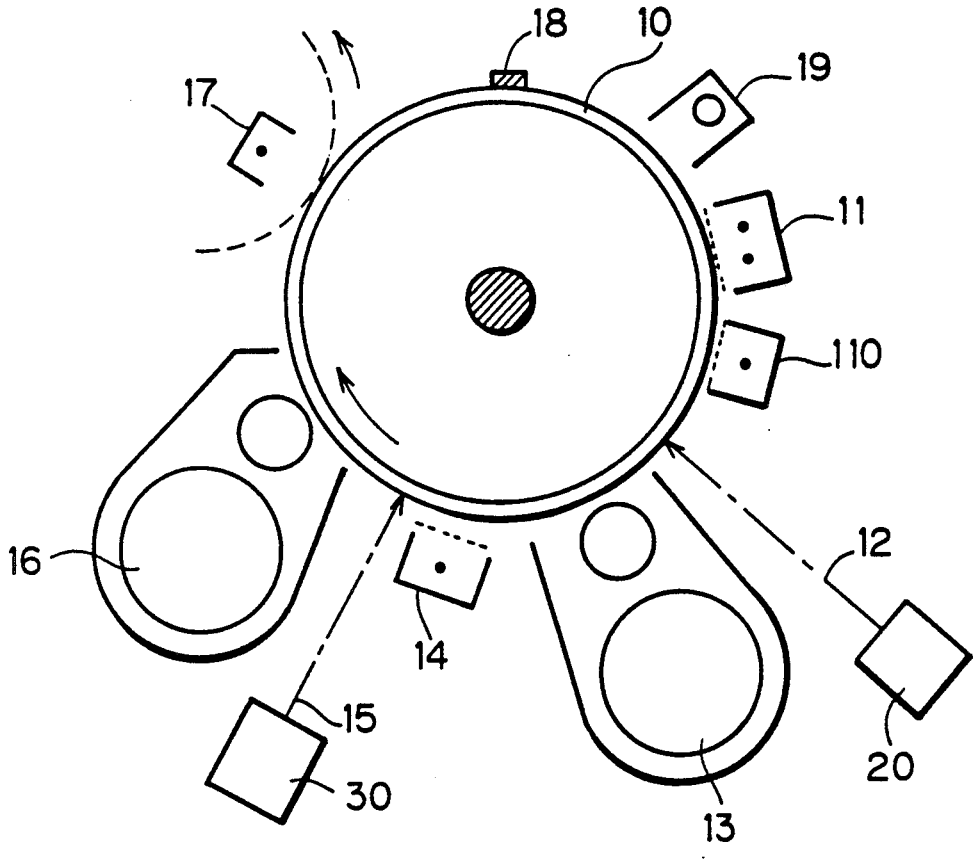
FIG. 6 is a schematic view showing the structure of a printer for carrying out a modified version of the method according to the present invention.

Referring to FIG. 6, a modified process of the present invention will be described together with a laser printer for carrying out the process.

FIG. 6 schematically shows a photosensitive drum 10 (hereinafter called the drum) and its peripheral part members.

Around the drum 10 are disposed a first charger (scorotron) 11, a side charger (scorotron) 110, a first developing unit 13, a second charger (scorotron) 14, a second developing unit 16, a transfer charger 17, a cleaning device 18 and an eraser lamp 19.

The printer includes optical systems 20 and 30 having laser heads for casting laser beams onto the drum 10, a polygon scanner, and mirrors; and a cassette for storing a recording material such as paper, feed rollers (not shown) for feeding the recording material out of the cassette, timing rollers for feeding it into a gap between the drum 10 and the transfer charger 17, and a fixing device (not shown) for fixing an toner image on the recording material transferred by the transfer charger 17 from the drum 10.

Figure 7:
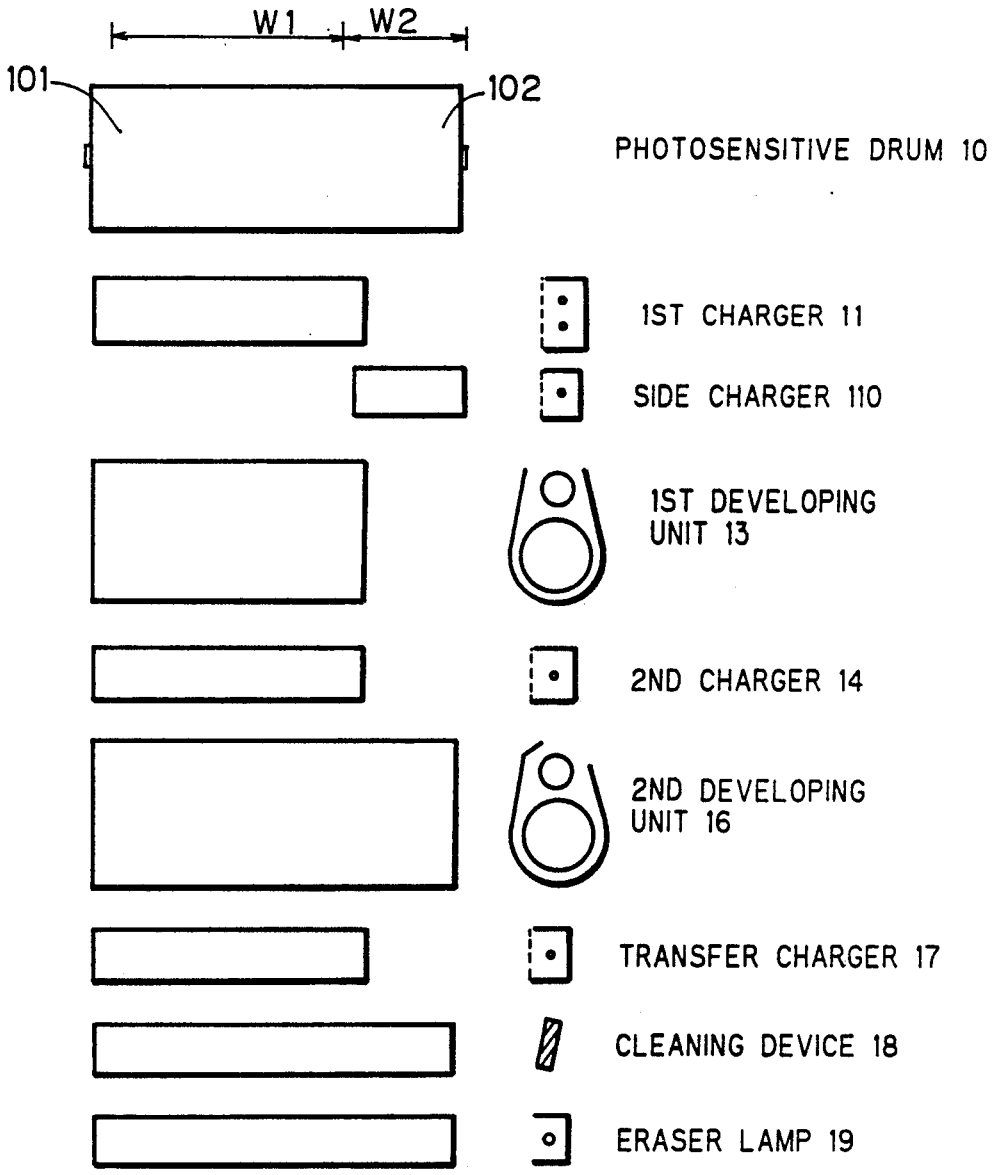
FIG. 7 is a diagrammatic view showing dimensional relationships among a photosensitive drum, a first charger, and other components.

The width of the drum 10 (i.e. the length of the drum in the direction of its rotating axis), and the lengths of the first charger 11 and other components each in the direction of the rotary axis of the drum 10 are shown in FIG. 7.

As clearly shown in FIG. 7 the drum 10 is longer by (W2) than a maximum width (W1) of an electrostatic latent image and a toner image formed thereon. The reference numeral 102 denotes an extended portion, which is hereinafter called "non-image forming portion". This portion 102 is used for removing a foreign toner.

The first charger 11 is long enough to agree with the width (W1) of the image, so that it can charge the portion 101 of the drum 10 along its own width corresponding to the width (W1). However the first charger 11 is not long to cover the non-image forming portion 102 of the drum 10 so that it cannot charge this portion 102 corresponding to the width (W2).

The side charger 110 is arranged so as to charge the longer portion 102 of the drum 10.

The first developing unit 13 is long enough to develop the portion 101 of the drum 10 corresponding to the width (W1). The second charger 14 is also long enough to charge the portion 101 corresponding to the width (W1). The second developing unit 16 is long enough to develop the entire length including the widths (W1) and (W2).

The width of the transfer charger 17, allowing a recording material such as paper to pass through, corresponds to the image width (W1).

The cleaning device 18 and the eraser lamp 19 are long enough to clean the drum surface and remove the charge thereon along the entire length (W1+W2) of the drum 10, respectively.

The first optical system 20 effects the first exposure 12 after the first charge is imparted on the drum 10 and the second optical system 30 effects the second exposure 15 after the second charge is imparted thereon. The first and second exposure are effected on the portion 101 alone which corresponds to the image width (W1).

Figure 8:
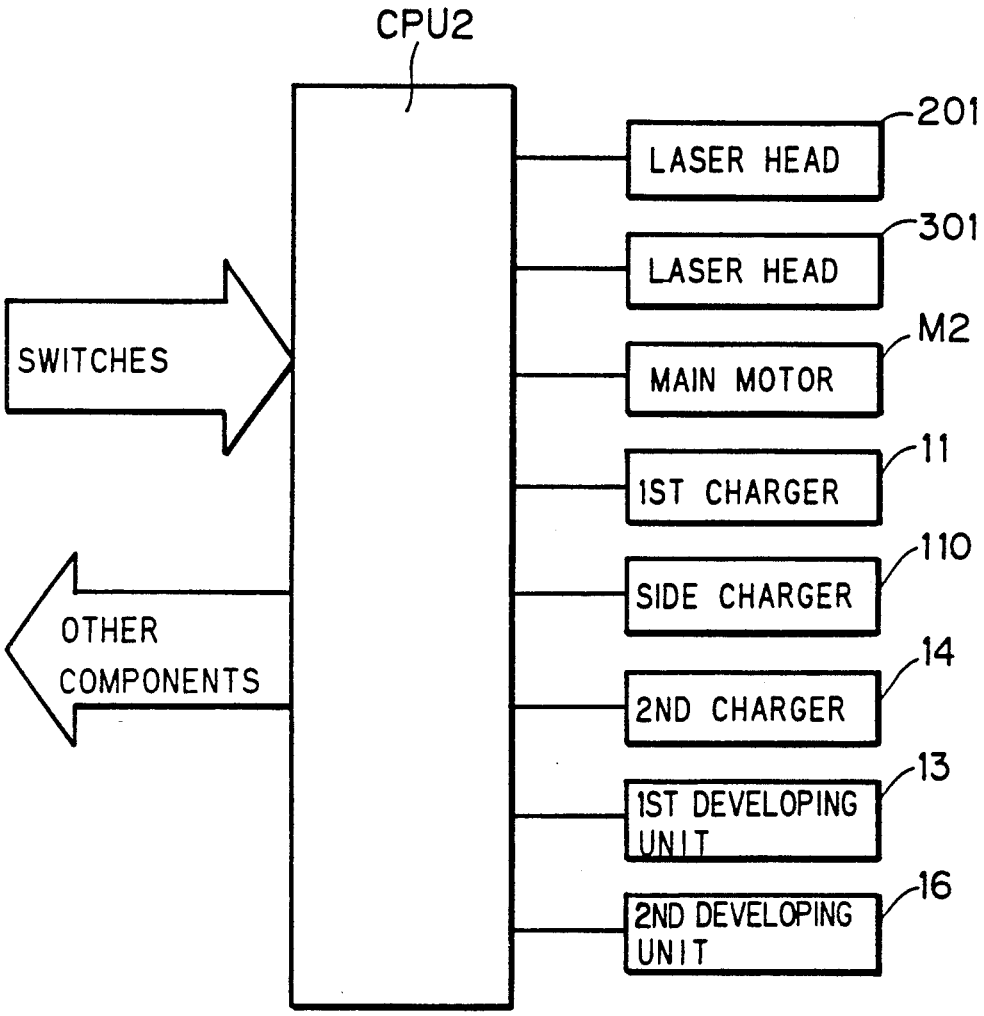
FIG. 8 is a diagram showing a control system of the printer of FIG. 6.

Referring to FIG. 8, a control system for controlling the printer shown in FIG. 6 will be described:

The control system includes a micro-computer CPU2, which is connected to a laser head 201 of the first optical system 20, a laser head 301 of the second optical system 30, the first charger 11, the side charger 110, the second charger 14, the first developing unit 13, the second developing unit 16, the main motor M2 (not shown in FIG. 6) and other components. These components are operated under control of the CPU2. The CPU2 receives inputs from a printer starting switch etc. on a control panel (not shown). The drum 10 etc. are driven by the main motor M2.

The first developing unit 13 is a magnetic brush type, which includes a fixed magnetic roller and a developing sleeve rotating around the magnetic roller. The first developing unit 13 stores a two-component developer containing a carrier and a toner. The carrier is made of spherical ferrite having an average diameter of 60 μm. The toner is a non-magnetic red toner and is negatively charged by friction with the carrier contained in the developer. More specifically, 100 parts by weight of styrene-acrylic copolymer, 4 parts by weight of a negative charge control agent and 5 parts of red pigment are mixed in their molten states, and after cooling, the resulting solid mass is crushed to granules and filtered to obtain particles having an average diameter of 11 μm. For the negative charge control agents a dye obtained by chelating Cr, Co, Fe, Al or any other metal can be used; in the illustrated embodiment "Bonfron S-34"

(produced by Oriental Chemical Co., Ltd.), which is made of chelated chromium. There are many red pigments which can be used; in the illustrated embodiment Watchung Red is used. The density of the toner in the developer is 5% by weight.

The second developing unit 16 is also a magnetic-brush type, which includes a fixed magnetic roller and a developing sleeve rotating around the magnetic roller. The developing unit 16 stores a two-component developer containing a toner and a binder-type carrier having an average diameter of 58 μm. The toner consists of magnetic black particles having an average diameter of 12 μm, and negatively charged by friction with the carrier. Hundred parts by weight of styrene-acrylic copolymer, 5 parts by weight of a negative charge control agent (e.g. "Bontron S-34"), 4 parts of carbon black, and 40 parts by weight of a magnetic powder are mixed in their molten states, and after cooling, the resulting solid mass is crushed to powder and filtered to obtain particles having an average diameter of 12 μm. The density of the toner in the second developing unit is 15% by weight.

The relationship among the adhesion-to-drum of non-magnetic red toner in the first developing unit 13, the magnetic black toner in the second developing unit 16 and the electrostatic contrast (V) is the same as that shown in FIG. 3.

The drum 10 is an organic photosensitive drum (OPC) having a negative charge polarity, and is rotated at a surfacial linear speed of 110 mm/sec (which agrees with the speed of the system).

In this example, the potentials for the components are as follows (FIG. 9):

The charging potential ($V_{O\,1}$) in an image forming portion 101 by the first charger 11: −600 (V)

This potential is achieved by keeping the potential at the controlling grid of the charger 11 −600 (V) or around.

The charging potential $V_{O\,1}$, in the longer portion 102 of the drum 10 by the side charger 110: −480 (V)

This potential is achieved by controlling the grid potential of the side charger 110.

The bias voltage $V_{B\,1}$ applied to the first developing unit 13: −450 (V)

The potential $V_{O\,2}$ of the image-forming portion 101 by the second charger 14: −700 (V)

This potential is also achieved by controlling the grid voltage.

The bias voltage $V_{B\,2}$ applied to the second developing unit 16: −550 (V)

The potential in the exposing section exposed to the first light 12 after the drum is charged by the first charger 11: −50 (V)

The potential in the exposing section exposed to the second light 15 after the drum is charged by the second charger 14: −60 (V)

Figures 9A, 9B, 9C, 9D, 9E:
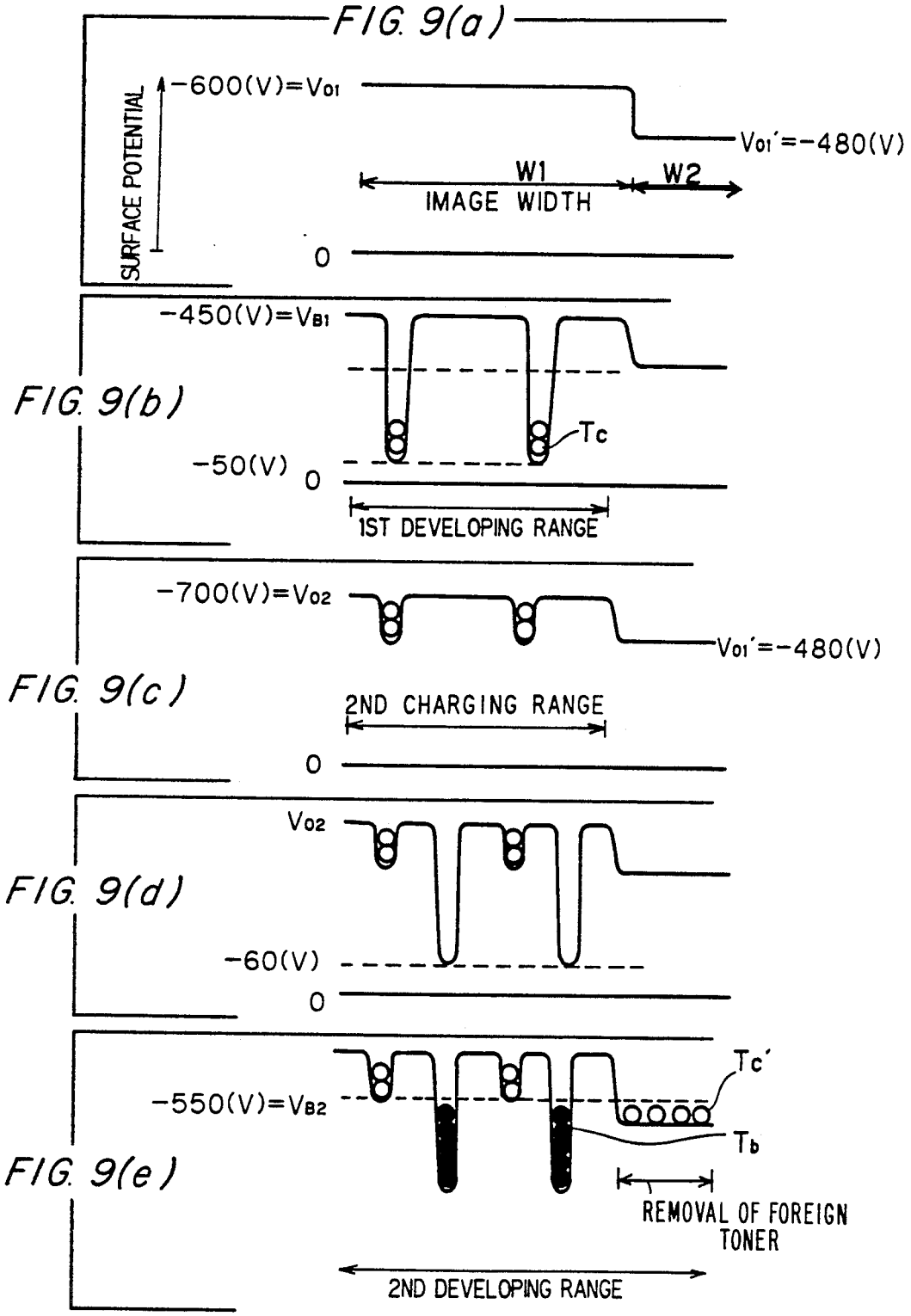
FIGS. 9(1) to 9(5) show the process of forming a two-color image on the photosensitive drum and removing a foreign toner mixed in a second developing unit.

In the printer shown in FIG. 6 the drum 10 is rotated by the main motor M2 in the clockwise direction in FIG. 6 under control provided by the control system shown in FIG. 8, and two-color image is formed by the processes (1) to (5) shown in FIG. 9, and the mixing toner is removed for collection.

Step (1): The drum 10 is charged by the first charger 11 and the side charger 110. The image-forming portion 101 is kept by the charger 11 at a potential $V_{O\,1}$ of −600 (V), and the longer portion 102 (non-image forming portion) is kept by the charger 110 at a potential $V_{O\,1}$ of −480 (V).

Step (2): The drum 10 is exposed to a first light 12 generated by the first optical system 20 (FIG. 6), thereby forming an electrostatic latent image in the image-forming portion 101. Then, the image is reversely developed by the first developing unit 13 at a bias voltage $V_{B\,1}$ of −450 (V), thereby enabling a red toner $T_c$ to adhere to the first latent image of the drum surface. Since the length of the developing unit 13 is short of the non-image forming portion 102, the red toner $T_c$ does not adhere thereto.

Step (3): The surfacial potential $V_{O\,2}$ in the image-forming portion 101 is equalized at −700 (V) by the second charger 14. Since the length of the charger 14 is short of the non-image forming portion 102, this portion is free from being charged, and the potential $V_{O\,1}$ remains at −480 (V).

Step (4): The drum surface is exposed to a second light 15 generated by the second optical system 30 to form a second electrostatic latent image.

Step (5): The second latent image is reversely developed with a black toner $T_b$ by the second developing unit 16.

The development by the second developing unit 16 will be described in greater detail:

The toner $T_b$ in the second developing unit is a magnetic toner, and is difficult to transfer to the drum 10 because of the magnetic restraint. This is why the bias voltage $V_{B\,2}$ in the second developing unit 16 is at a higher voltage (−550 (V)) than the bias voltage $V_{B\,1}$ (−450 (V)) in the first developing unit 13, thereby securing a large electrostatic contrast to the potential (−60 (V)) in the second exposing section.

While the second developing unit develops the second image, some of the first toner (red toner) on the drum 10 is unavoidably scraped off by the magnetic brush of the second developing unit 16 and gradually intruding into the second developing unit 16.

In the illustrated embodiment the red toner and the black toner contain the same negative charge control agent. This minimizes the mutual charging of two toners but allows them to be negatively charged for the carrier, thereby enabling them to adhere to the carrier. This is effective to prevent the red toner from reversing to the opposite polarity and scattering even if it intrudes into the second developing unit 16.

The red toner intruding in the second developing unit 16 is separated and removed in the following manner:

As shown in FIG. 3 the adhesion-to-drum of the magnetic black toner increases with an increase in electrostatic contrast (V) from Point (P) of 100, which means that the development initiating voltage is about 100 (V). Whereas, the adhesion-to-drum amount of the non-magnetic red toner increases with an increase in electrostatic contrast from Point (P) of zero (0), which means that the development can start at a considerably lower voltage than 100 (V).

The second developing unit 16 has such an effective width as to cover the entire length of the drum 10, thereby enabling the unit 16 to develop not only the image-forming portions 101 but also the non-image forming portion 102. The potential $V_{O\,1}$ in the non-image forming portion 102 is −480 (V), and a bias voltage of −550 (V) is applied to the developing sleeve of the second developing unit 16. As a result, an electrostatic contrast of 70 (V) sets up to transfer the negatively charged toner to the non-image forming portion 102.

It will be understood from FIG. 3 that at point P (70 (V) for electrostatic contrast) very little magnetic black toner transfers to the non-image forming portion 102 whereas the non-magnetic red toner transfers and adheres thereto.

More specifically, in the development by the second developing unit 16 the reversal development occurs on the image-forming portion 101, whereas the non-magnetic red toner adheres to the non-image forming portion 102. The toner image on the image-forming portion 101 is transferred onto a recording material such as paper by the transfer charger 17. The toner $T_c$ on the non-image forming portion 102 and a residual toner on the image-forming portion 101 are cleaned off the drum surface by the cleaning device 18 having a sufficient width to cover the entire length of the drum 10.

Then the charges on the whole drum surface are removed by the eraser lamp 19, and is ready for the charges by the first charger 11 and the side charger 110.

As is evident from the foregoing description, the non-magnetic red toner mingled in the second developing unit 16 is caused to adhere to the non-image forming portion 102 of the drum 10, and removed therefrom by the cleaning device 18 without using a special means for removing it.

Figure 10:
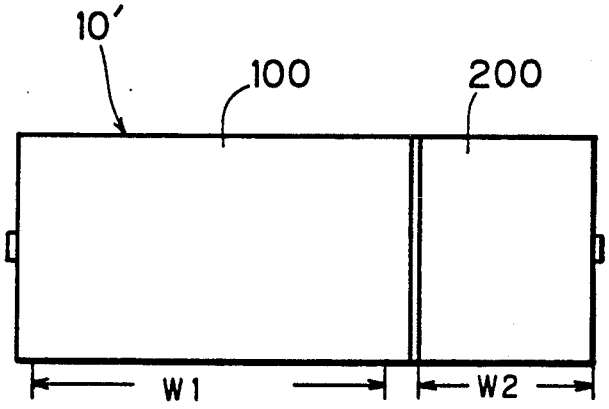
FIG. 10 is a schematic view showing a modified version of an image bearer.
Figure 11:
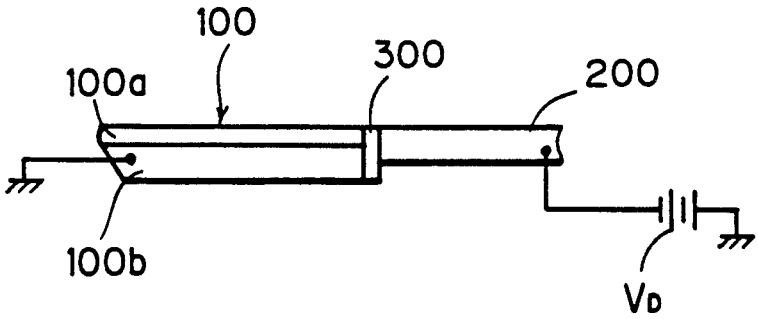
FIG. 11 is a diagrammatic view exemplifying the structure of the image bearer of FIG. 10.
Figure 12:
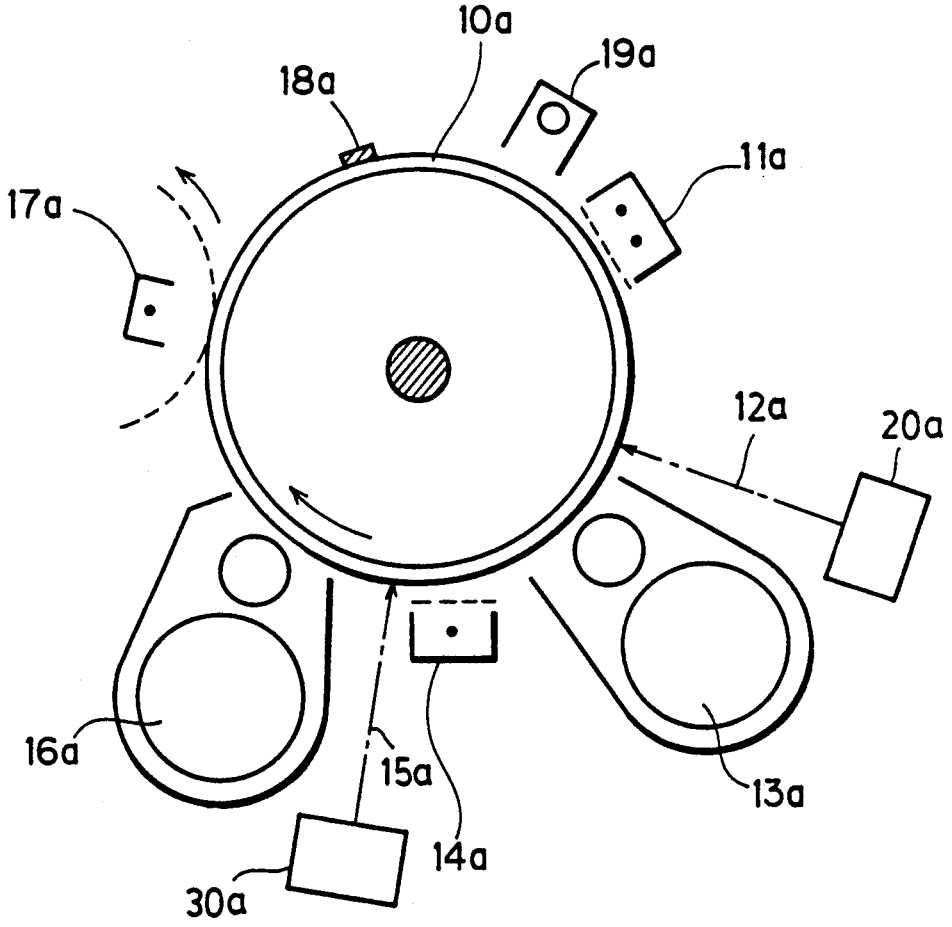
FIG. 12 (PRIOR ART)
FIG. 12 is a schematic view showing the structure of a known printer.
Figure 13A:
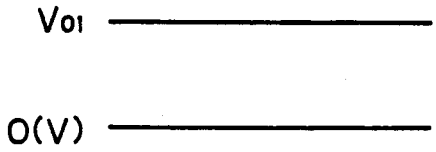
FIG. 13(a) PRIOR ART
FIGS. 13(1) to 13(6) show the steps of an image forming process by the printer of FIG. 12.
Figure 13B:
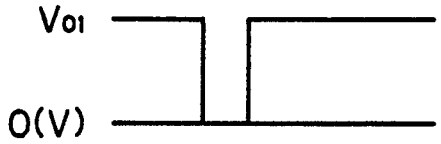
FIG. 13(b) PRIOR ART
Figure 13C:
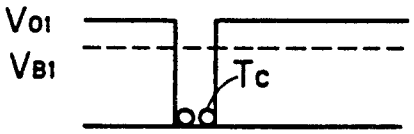
FIG. 13(c) PRIOR ART
Figure 13D:
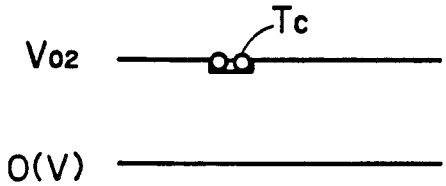
FIG. 13(d) PRIOR ART
Figure 13E:
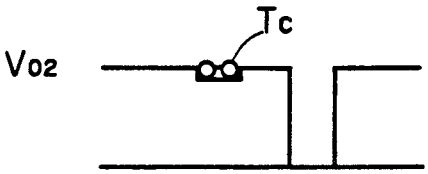
FIG. 13(e) PRIOR ART
Figure 13F:
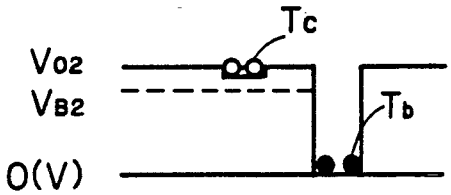
FIG. 13(f) PRIOR ART

Instead of the drum 10 it is possible to employ a special drum 10' shown in FIGS. 10 and 11 which consists of a photosensitive drum portion 100 and a toner collector drum 200. The photosensitive drum portion 100 has a sufficient width W1 to form an image thereon, and the toner collector drum 200 has a width W2 which corresponds to the width of the non-image forming portion 102 described above.

Referring to FIG. 11 the toner collector drum 200 is made of aluminum, and electrically insulated from an aluminum body of the photosensitive drum portion 100 by an insulating ring 300. The reference numeral 100*a* denotes a photosensitive layer covering the aluminum body 100*b*. The aluminum body 100*b* is grounded but the toner collector drum 200 holds a bias voltage $V_D$ (e.g. −480 (V)), which corresponds to the voltage $V_{O1}$, applied to the non-image forming portion 102 in the embodiment described above. In this embodiment the side charger 110 is not necessary. The diameters of the photosensitive drum portion 100, the insulating ring 300 and the toner collector drum 200 are the same so as to produce a smooth uniform peripheral surface as a whole. The uniform surface enables the cleaning device 18 to clean the toner thereon. The eraser lamp 19 has only to be as long as to cover the photosensitive drum portion 100. The toner collector drum 200 may have a thin insulating coating on the aluminum base.

In this example the red toner and the black toner contain the same negative charge control agent but the important thing is to prevent the first toner mingled in the second developing unit from reversing to the opposite polarity. If the polar reversal is prevented, it is not always necessary to use the same negative charge control agent in the first and second toners.

The black toner is magnetic but it is not always necessary to use a magnetic toner if a sufficient electrostatic contrast is achieved to separate the toner mingled in the second developing unit.

Throughout the examples described above the potentials on the image-forming portion, the bias voltage for developing, the potentials on the non-image forming portion and the toner collector drum are not limited to the figures enumerated above but can be variously changed within the spirit and scope of the present invention.

In the illustrated embodiments the electrostatic latent image is developed by a reversal development but it is of course possible to form a positive image through a positive exposure, and develop the positive image by a regular development. In the embodiments described above a second charge is applied to the drum by the second charger 24 or 14 prior to forming the second electrostatic latent image but the second charge is not always necessary to form the second latent image.

What is claimed is:

1. A method of forming a multi-color toner image comprising the steps of:

forming a first electrostatic latent image on an image-forming portion of an image bearer;

developing the first electrostatic latent image by using a first toner stored in a first developing unit;

forming a second electrostatic latent image on the image-forming portion;

developing the second electrostatic latent image by using a second toner stored in a second developing unit, wherein the second toner is transferrable to the image bearer under a higher bias voltage than that of the first toner, and the first toner which has been mixed into the second developing unit is chargeable to the same polarity as that of the second toner by friction with a carrier in the second developing unit;

transferring electrostatically the first and second toner images onto a recording medium; and operating only the second developing unit for a non-image forming portion, wherein a voltage applied to the second developing unit is maintained at a higher voltage than the surface potential of the non image-forming portion so as to enable the first toner which has been mixed into the second developing unit to adhere to the non-image forming portion.

2. A method as defined in claim 1, wherein the first toner is a non-magnetic toner, and the second toner is a magnetic toner, and wherein both toners contain the same charge control agent.

3. A method as defined in claim 1, further comprising the steps of charging the image bearer by a first charger prior to forming the first electrostatic latent image thereon, and of charging the image bearer by a second charger prior to forming the second electrostatic latent image thereon.

4. A method as defined in claim 3, further comprising the step of operating the first charger for the non-image forming portion.

5. A method as defined in claim 3, further comprising the step of operating the second charger for the non-image forming portion.

6. A method as defined in claim 3, wherein the first charger and the second charger are kept out of operation for the non-image forming portion.

7. A method of forming a multi-color toner image comprising the steps of:

forming a first electrostatic latent image on an image-forming portion of an image bearer, wherein said image bearer has the image forming portion and a non-image forming portion adjacent to the image-forming portion;

developing the first electrostatic latent image by using a first toner stored in a first developing unit;

forming a second electrostatic latent image on the image-forming portion;

developing the second electrostatic latent image by using a second toner stored in a second developing unit, wherein the second toner is transferrable to the image bearer under a higher bias voltage than that of the first toner, and the first toner which has been mixed into the second developing unit is chargeable to the same polarity as that of the second toner by friction with a carrier in the second developing unit, wherein a voltage applied to the second developing unit is maintained at a higher voltage than the surface potential of the non-image forming portion so as to enable the first toner which has been mixed into the second developing unit to adhere to the non-image forming portion; and transferring electrostatically the first and second toner images onto a recording medium.

8. A method as defined in claim 7, wherein the first toner is a non-magnetic toner, and the second toner is a magnetic toner, and wherein both toners contain the same charge control agent.

9. A method as defined in claim 7, further comprising the steps of:

charging the image-forming portion of the image bearer by a first charger having a length corresponding to that of the image-forming portion prior to forming the first electrostatic latent image on the image bearer;

charging the image-forming portion of the image bearer by a second charger having a length corresponding to that of the image-forming portion prior to forming the second electrostatic latent image on the image bearer; and charging the non-image forming portion of the bearer by a third charger having a length corresponding to the length of the non-image forming portion.

10. A method as defined in claim 7, wherein the image-forming portion and the non-image forming portion are photosensitive.

11. A method as defined in claim 7, wherein the non-image forming portion is electrically conducive but insulated from the image forming portion.

12. A method as defined in claim 11, further comprising the step of applying a voltage to the non-image forming portion of the image bearer while the second developing unit develops the second electrostatic latent image on the image bearer, thereby enabling the foreign first toner mixed in the second developing unit to adhere to the non-image forming portion.

13. A method for forming a multi-color image, the method comprising the steps of:

forming a first electrostatic latent image on an image bearer through a first exposure;

developing the first electrostatic latent image into a first toner image by using a first non-magnetic color toner and a first voltage;

forming a second electrostatic latent image on the image bearer through a second exposure;

developing the second electrostatic latent image into a second toner image by using a second voltage and a second magnetic color toner charged to the same polarity as that of the non-magnetic toner;

transferring electrostatically the first toner image and the second toner image onto a recording material; and conducting the same process for the non-image forming portion of the image bearer at a third voltage as the process of applying the second voltage to the magnetic toner to form the second toner image, wherein the third voltage is maintained to be higher than the surface potential of the non-image forming portion.

14. A method as defined in claim 13, further comprising the steps of:

charging the image bearer prior to forming the first electrostatic latent image thereon; and charging the image bearer prior to forming the second electrostatic latent image thereon.

15. A method for forming a multi-color image, the method comprising the steps of:

preparing an image bearer including an image-forming portion and a non-image forming portion carried on the same axis;

forming a first electrostatic latent image on the image-forming portion of the image bearer through a first exposure;

developing the first electrostatic latent image into a first toner image by using a first non-magnetic color toner and a voltage applied to the developing unit;

forming a second electrostatic latent image on the image-forming portion of the image bearer through a second exposure;

developing the second electrostatic latent image into a second toner image by using a voltage and a second magnetic color toner charged to the same polarity as that of the first non-magnetic color toner, wherein the bias voltage is maintained to be higher than the surface potential of the non-image forming portion; and transferring electrostatically the first toner image and the second toner image onto a recording material.

16. A method as defined in claim 15, further comprising the steps of:

charging the image-forming portion prior to forming the first electrostatic latent image thereon;

charging the non-image forming portion of the image bearer subsequently to the first charging step; and charging the image forming portion prior to forming the second electrostatic latent image on the image forming portion.

17. A multi-color image forming apparatus comprising:

a movable image bearer;

means for forming a first and second electrostatic latent image on an image-forming portion of said image bearer;

first developing means for developing the first electrostatic latent image with a magnetic toner charged to a predetermined polarity;

second developing means for developing the second electrostatic latent image with a magnetic toner charged to a polarity the same as the predetermined polarity, wherein a developing bias with a first voltage is applied to said second developing means;

control means for controlling the operation of said second developing means so that the second developing means is operated for a non-image forming portion of the image bearer, wherein a developing bias with a second voltage which is higher than a surface potential of a non-image forming portion of the image bearer is applied to said second developing means so as to enable the non-magnetic toner mixed into the second developing means to adhere to the non-image forming portion.

* * * * *